US009354014B2

(12) United States Patent
Swadener et al.

(10) Patent No.: US 9,354,014 B2
(45) Date of Patent: May 31, 2016

(54) CHARGING HANDLE ACCESSORY FOR FIREARM

(71) Applicants: Christopher Luke Swadener, Manassas, VA (US); Chadwyck Cobb, Woodland Park, NJ (US); Noah Nathaniel Walker, Arlington, VA (US)

(72) Inventors: Christopher Luke Swadener, Manassas, VA (US); Chadwyck Cobb, Woodland Park, NJ (US); Noah Nathaniel Walker, Arlington, VA (US)

( * ) Notice: Subject to any disclaimer, the term of this patent is extended or adjusted under 35 U.S.C. 154(b) by 0 days.

(21) Appl. No.: 14/800,209

(22) Filed: Jul. 15, 2015

(65) Prior Publication Data

US 2016/0018181 A1 Jan. 21, 2016

Related U.S. Application Data

(60) Provisional application No. 62/024,498, filed on Jul. 15, 2014.

(51) Int. Cl.
*F41A 3/72* (2006.01)
*F41A 35/06* (2006.01)

(52) U.S. Cl.
CPC .. *F41A 35/06* (2013.01); *F41A 3/72* (2013.01)

(58) Field of Classification Search
CPC ..... F41A 3/72; F41A 19/34; F41A 19/37; F41A 19/47; F41A 19/50; F41A 35/06
USPC ..... 89/1.4, 1.42
See application file for complete search history.

(56) References Cited

U.S. PATENT DOCUMENTS

| | | | | |
|---|---|---|---|---|
| 7,231,861 | B1 * | 6/2007 | Gauny | F41A 3/72 42/16 |
| 8,567,301 | B1 | 10/2013 | Sharron | |
| 8,863,632 | B1 * | 10/2014 | O'Malley | F41A 3/72 42/16 |
| 2013/0061737 | A1 | 3/2013 | Brown | |
| 2014/0068988 | A1 * | 3/2014 | Donahue | F41A 3/72 42/69.01 |
| 2014/0345444 | A1 * | 11/2014 | Hillman | G01N 15/06 89/1.4 |
| 2015/0233663 | A1 * | 8/2015 | Kiehn | F41C 33/001 42/90 |
| 2015/0253105 | A1 * | 9/2015 | Brubaker | F41A 35/06 42/90 |
| 2016/0018181 | A1 * | 1/2016 | Swadener | F41A 3/72 42/90 |

* cited by examiner

*Primary Examiner* — Bret Hayes
*Assistant Examiner* — Derrick Morgan
(74) *Attorney, Agent, or Firm* — David G. Oberdick

(57) ABSTRACT

An externally mounted firearm accessory and a method of operating the accessory. The firearm accessory includes a mounting clamp and a collar offset extending from the mounting clamp on the side of the firearm on which the bolt catch/release is located, a shaft that is slidably mounted on the collar, a handle at the forward end of the shaft, and a slot at the rear end of the shaft that receives and holds the charging handle of the firearm accessory. The slot is positioned in relation to the charging handle so that, in operation, a user of the firearm accessory pulls rearward on the handle of the shaft of the firearm accessory to push the charging handle rearward and, thereby, depress and open the latch of the charging handle of the firearm. At this point, the user can then push the handle of the firearm accessory forward to pull the charging handle of the firearm into a closed and latched position. A biased spring mechanism associated with the charging handle can also act to push the charging handle forward.

17 Claims, 12 Drawing Sheets

CHARGING HANDLE ACCESSORY FOR FIREARM

CROSS-REFERENCE TO RELATED APPLICATIONS

This application claims the benefit under 35 U.S.C. §119 of U.S. Provisional Application Ser. No. 62/024,498, filed Jul. 15, 2014, which is incorporated by reference herein in its entirety.

FIELD OF THE INVENTION

The present invention is in the technical field of firearms. More particularly, the present invention is in the technical field of firearm accessories.

BACKGROUND

The invention is designed for use on a gas or piston-operated automatic or semiautomatic firearm such as a carbine, rifle, or pistol so as to relocate operation of the charging handle of a firearm, such as a Colt M4A1 5.56 carbine, M-16, AR-15, or AR-10. It can also be used with other similar firearms.

The charging handle of said firearm comprises a shaft having a forward end portion in the direction of the firearm barrel and a rearward end portion in the direction of the firearm stock. The rearward end portion has a latch engaging the receiver of the firearm to hold the charging handle in a forward most position.

The current method of operation of the charging handle includes holding the firearm with a first hand engaging the pistol grip and a second hand holding the foregrip. The user then, removes the first or second hand from either the pistol grip or the foregrip, firmly grabs the charging handle, disengaging the latch from the receiver of the firearm, and pulls the charging handle towards the rear of the firearm. When the charging handle can no longer travel to the rear, the user releases the charging handle and allows the charging handle to return to the forward position via spring force within the firearm. This method is cumbersome because it results in the position of the hand that is used to operate the charging handle to move to a body position that requires the majority of the weight of the rifle, being in the barrel and forward end, to be supported from a position in the rear of the rifle rather than a more comfortable position closer to the front of the rifle. In addition, the current method, without use of the present invention, can require the user to dismount the firearm from their shoulder and remove their face from the sightline of the firearm in order to have sufficient clearance for their arm to move in relation to their body and the mounted clearance of the firearm.

In contrast, the present invention changes and simplifies the standard operation of the charging handle of a firearm explained above. In particular, the present invention provides a simple means of comfortably pushing the charging handle to its rear position.

BRIEF SUMMARY OF THE INVENTION

The present invention is an externally mounted firearm accessory that relocates a firearm's charging handle manipulation position. Broadly stated, the present invention is an externally mounted charging handle relocation and assist device.

The present invention is a unit or assembly for modifying a gas or piston-operated automatic or semiautomatic firearm such as a carbine, rifle, or pistol so as to relocate operation of the charging handle of a firearm, such as a Colt M4A1 5.56 carbine, M-16, AR-15, or AR-10.

The present invention affixes to the firearm on the top rail of the firearm's receiver. This mount also features a collar by which a shaft translates parallel to the length of the firearm. A handle is affixed at the front of the shaft and the charging handle of the firearm fits within a slot in the rear of the shaft.

When the present invention is affixed to the firearm, the charging handle is manipulated by the shaft handle of the invention rather than the original handle of the charging handle of the firearm. By pulling rearward on the shaft handle of the present invention, the shaft of the present invention depresses and opens or releases the latch of the charging handle of the firearm and subsequently pushes the charging handle of the firearm to the rear of the rifle. In one embodiment, when the charging handle can no longer travel to the rear, the user releases the handle of the present invention and allows the charging handle of the firearm to return to a forward position via a standard biased spring mechanism within the firearm. Through this operation, the charging handle of the firearm also pushes the shaft of the present invention back to its initial forward position. Alternatively, the user can use the shaft handle to push the shaft forward and, thereby, pull the charging handle forward at the same time.

A further object of the invention is to provide a simple means of comfortably pushing the charging handle to its rear position.

It is still another object of the present invention to allow the user's operating hand to be closer to the front of the firearm during the process of manipulating the charging handle of the firearm to the charging handle's rear most position.

It is another object of the present invention to position the user's operating hand near the bolt catch/release of the firearm, in the process of manipulating the charging handle of the firearm, in order to more easily operate said release.

The advantages of the present invention include, without limitation, the ability to manipulate the charging handle of the firearm from the side of the firearm rather than the rear. As a result, the present invention allows the user to more comfortably operate the charging handle of the firearm. The side charging system is more ergonomically useful than a rear charging system.

The invention also allows for the firearm's bolt to be locked to the rear, an operation that normally requires relocation of both hands on the rifle, to be performed with the relocation of only one hand. This eliminates the need to remove the rifle from the user's shoulder as is necessary when relocating both hands in traditional operation.

The present invention can increase the speed of operating the charging handle of the firearm and subsequently any functions associated with the firearms that require the use of the charging handle. The present invention also has the possibility to increase the safety of operation by allowing the user to minimize unsafe movement of the barrel of the firearm during the operation of the charging handle of the firearm.

The present invention also attaches to the firearm on a location above the trigger that does not negatively affect the balance of the firearm because the majority of the firearm's weight is located in this position.

The present invention contains only one moving part which reduces the likelihood of errors or jamming. The present invention, as embodied, also has a robust and simple design being less likely to be bent into an unusable shape with heavy use.

The present invention allows the charging handle latch of the firearm to function without modification. This enables the present invention to work with many different types of after-market charging handles without much complication.

The location and size of the present invention's handle enables the user to adequately grasp the handle under numerous different environmental conditions.

Due to the present invention's single connection point with the firearm, the invention is simple to attach or remove. The present invention is entirely external to the firearm and no modifications of the firearm's components are required for the attachment or use of the present invention. The present invention is a non-permanent accessory that is easy to attach and detach as necessary from railed attachment points on the firearm.

The present invention has a low profile in relation to the side, front, and top views of the firearm. This low profile reduces the likelihood of the present invention interfering with any other accessories that the user may attach to the firearm. This non-obtrusive design is visually appealing and is further supported by the angular embodiment of components.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DETAILED DESCRIPTION OF THE INVENTION

Figure 1:
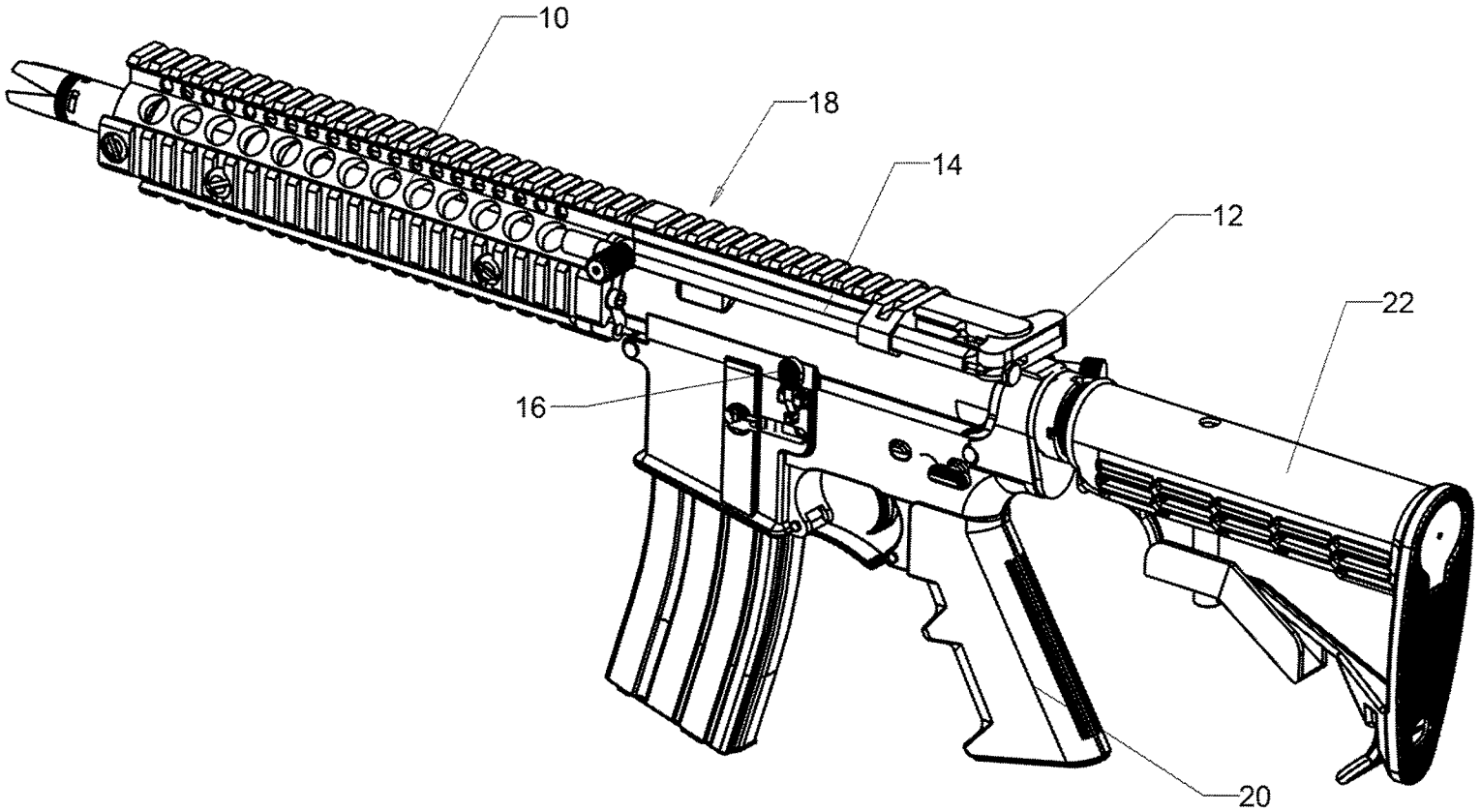
FIG. 1 is a perspective view of one embodiment of the present invention attached to a firearm.

Referring now to the invention in more detail, FIGS. 1-5 depict one embodiment of the present invention. FIG. 1 shows a firearm with the present invention, the charging handle accessory 14, affixed to the top rail of the firearm 18. The firearm consists of a rear stock 22, a pistol grip 20, a foregrip 10, a bolt catch/release 16, and a charging handle 12.

For most users, their dominant hand grabs the pistol grip 20 while their non-dominant hand grabs the foregrip 10. The rear stock 22 is designed to be put to the dominant shoulder of the user. When the user operates the charging handle 12, the charging handle 12 travels towards the rear stock 22. The bolt catch/release 16 is located on the left side of the firearm in FIG. 1 and manipulates the locking position of the interior bolt (not shown). The bolt catch/release can also be located on the right side of the firearm.

Figure 2:
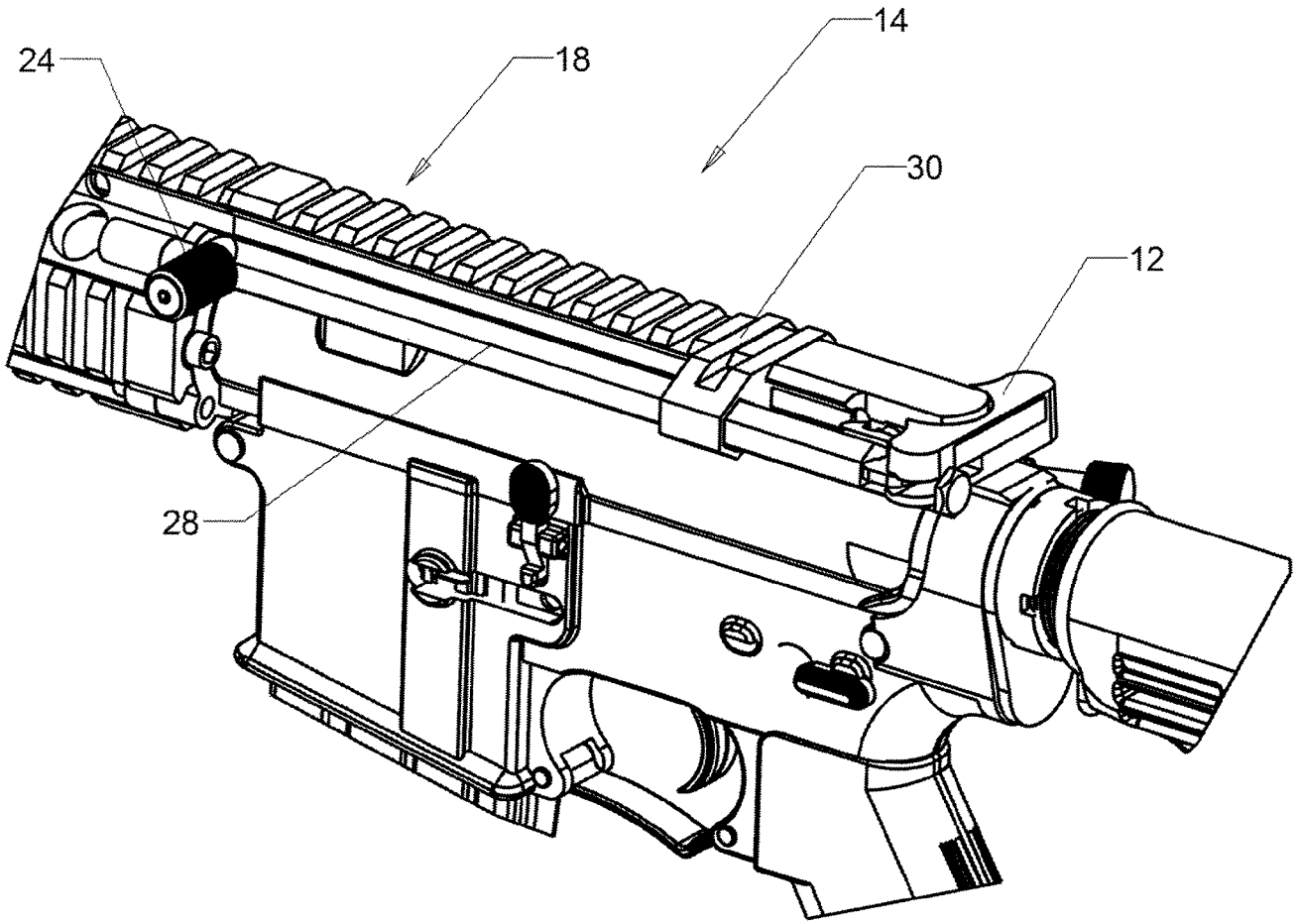
FIG. 2 is an enlarged perspective view of the left side of the embodiment of the present invention shown in FIG. 1, as attached to a firearm.

In FIG. 2 there is shown an enlarged view of the charging handle accessory 14 mounted on the top rail of the firearm 18. The charging handle accessory 14 has a handle 24 attached to a shaft 28 and a mounting clamp 30. The charging handle accessory 14 is in contact with the firearm's charging handle 12.

Figure 3:
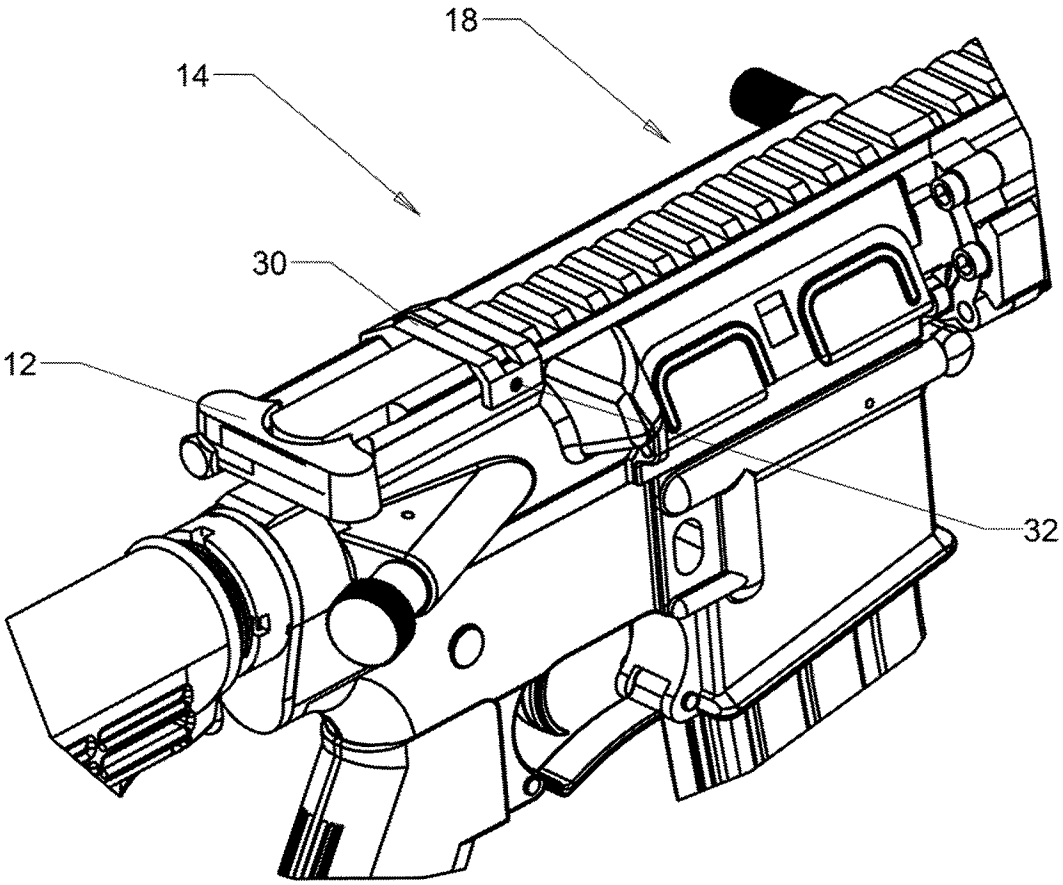
FIG. 3 is a perspective right side view of the embodiment of the present invention shown in FIG. 1.

In FIG. 3, the charging handle accessory 14 is attached to the top rail 18 shown in FIG. 1 by a mounting clamp 30. The mounting clamp 30 has an attachment feature 32 showing a set screw. The mounting clamp 30 fits over the top of the top rail 18 and uses attachment feature 32 to be affixed to the body of the firearm. Attachment feature 32 can be located elsewhere, and the mounting clamp 30 can be attached with many other attachment features such as different types of screws, pins, or press fits.

Figure 4:
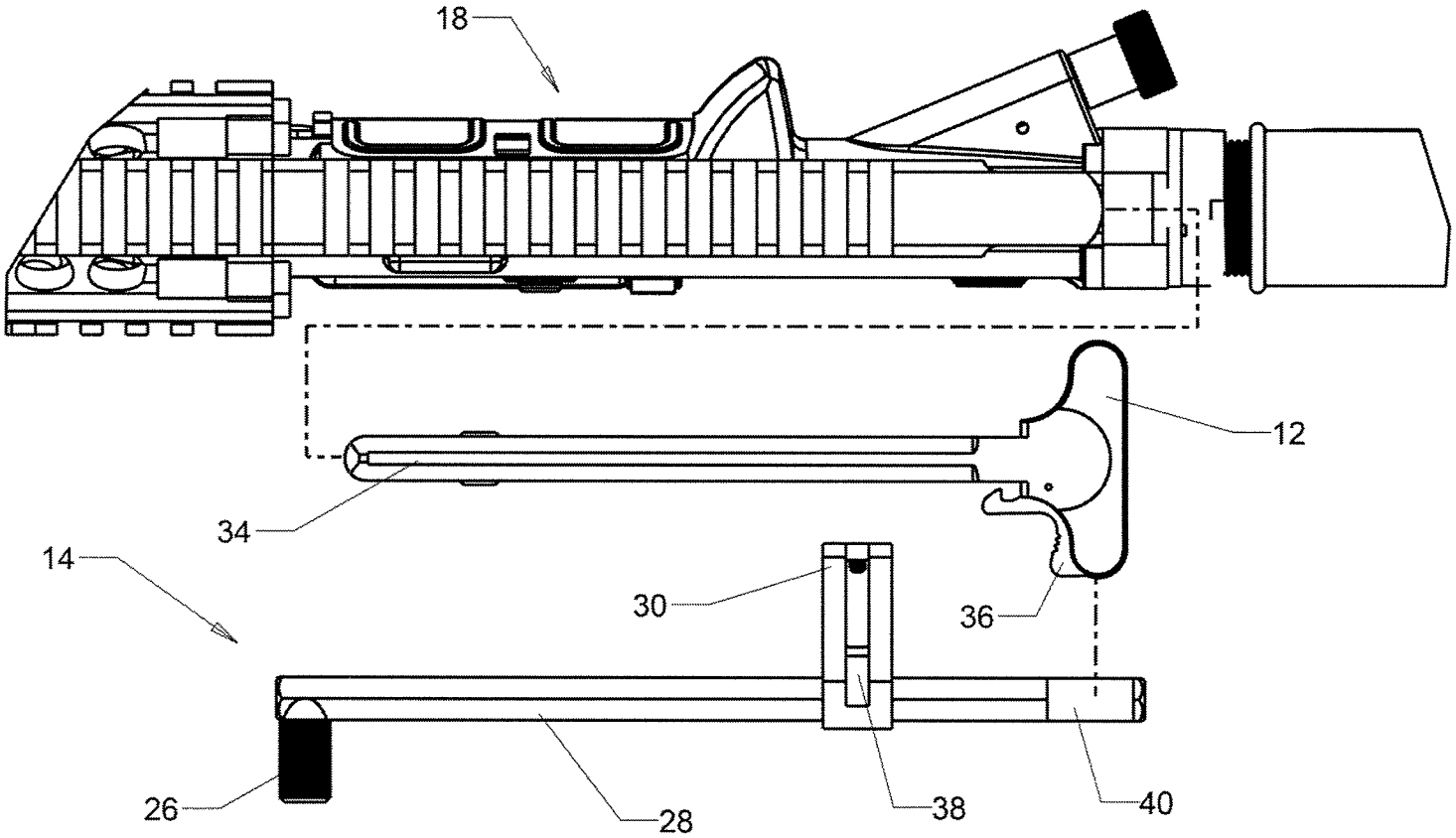
FIG. 4 is an exploded top view of the embodiment of the present invention shown in FIG. 1, in relation to the firearm.

FIG. 4 shows a partially exploded view of the firearm, the charging handle 12, and the charging handle accessory 14. In a typical firearm having a rear charging handle, the charging handle 12 consists of a charging handle shaft 34 and a charging handle latch 36. The charging handle shaft 34 slidably fits within the body of the firearm leaving the externally visible portion of the charging handle 12 exposed for use by the user or operator. When depressed with rearward pressure, the charging handle latch 36 opens and releases the charging handle 12 allowing the charging handle 12 to slide along the longitudinal axis and to the rear of the firearm.

In more detail, referring to FIG. 4, the charging handle accessory 14 has a mounting clamp 30 with a mounting clamp slot 38. In one preferred embodiment, the mounting clamp slot 38 is the width of a single transverse ridge of the top rail 18. The total width of the mounting clamp 30 allows the mounting clamp to fit within the slots of the top rail 18 that are adjacent to a single ridge of the top rail.

Again referring to FIG. 4, the charging handle accessory 14 has a transverse slot 40 in the rear of the shaft 28. When the mounting clamp 30 is affixed to the top rail 18, this slot 40 receives and holds both the charging handle 12 and charging handle latch 36, enabling the charging handle accessory 14 to longitudinally manipulate the charging handle latch 36 and subsequently the charging handle 12.

Referring again to FIG. 4, the shaft 28 of the charging handle accessory 14 slidably fits within the mounting clamp giving it the ability to slide laterally. The shaft 28 is able to be manipulated to the rear of the rifle by the handle 24. When the charging handle accessory 14 is mounted to the firearm, applying force to the handle 24 allows the user to manipulate the longitudinal direction of the charging handle 12.

Figure 5:
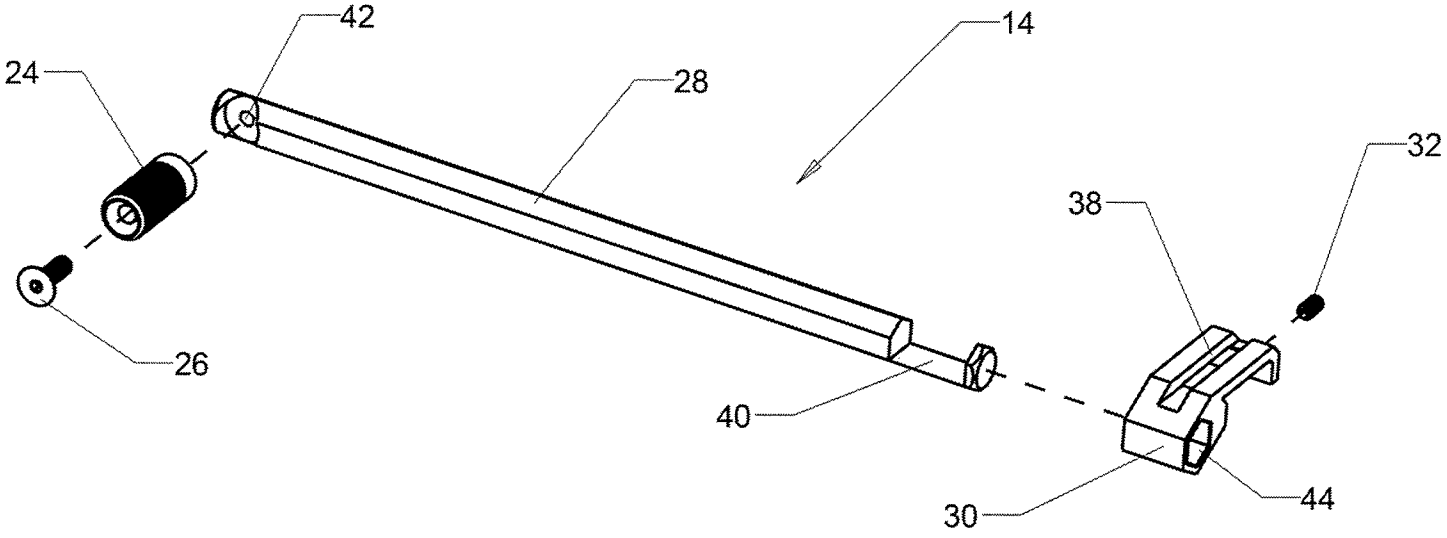
FIG. 5 is an exploded left perspective view of the embodiment of the present invention shown in FIG. 1.

FIG. 5 shows an exploded view of the charging handle accessory 14. The handle 24 is affixed to the shaft 28 with attachment feature 26 showing a flat head screw. The handle 24 is sufficiently offset and large enough to allow for comfortable gripping with a human finger, a gloved hand, prosthetic, or similar gripping device. The handle 24 can be attached with many other attachment features such as different types of screws, pins, or press fits. The attachment feature 26 is screwed into clearance hole 42. In referring to the invention of FIG. 1, this clearance hole 42 consists of a recessed setting and a threaded clearance hole that extends entirely through the shaft 28.

In more detail, still referring to the invention shown in FIG. 5, there is a rear shaft slot 40 located at the rear of the shaft 28. The charging handle accessory 14 also consists of a mounting clamp 30 having a mounting clamp slot 38 and a mounting clamp collar 44. The shaft 28 slidably fits within the mounting clamp collar 44. The attachment feature 32 affixes to the far side of the mounting clamp.

In further detail, referring again to the invention of FIG. 1, the shaft 28 of the charging handle accessory 14 is long enough to fully extend the charging handle 12 rearward. When the handle 24 of the charging handle accessory 14 is manipulated to its reward position, the user's or operator's hand is located close to the bolt catch/release 16.

The mounting clamp 30 positions the shaft 28 to be offset from the side of the firearm to provide clearance for respective mounting of optics or other types of accessories to the top rail 18 of the firearm. The offset nature of the shaft 28 additionally prevents the charging handle accessory 14 from interfering with the bolt catch/release 16 or any other component that is necessary to operate the firearm.

Referring to FIG. 5, the charging handle 12 generally consists of a depressible charging handle latch 36 that latches to the body of the firearm. Charging handle latch 36 can have varying shape and sizes, and can be comprised of different rigid materials. The invention has a shaft rear slot 40 which is sufficiently long enough to encompass a variety of charging handle latches 36. This shaft rear slot 40 provides enough surface area in contact with the latch to push the latch rearward. This shaft rear slot 40 also provides enough surface area in contact with the charging handle 12 to pull the charging handle back to its foremost position.

The shaft 28 of the present invention is rigid such that rearward pressure on the handle 24 of the charging handle accessory 14 can depress and open or release the charging handle latch 36.

Figure 6:
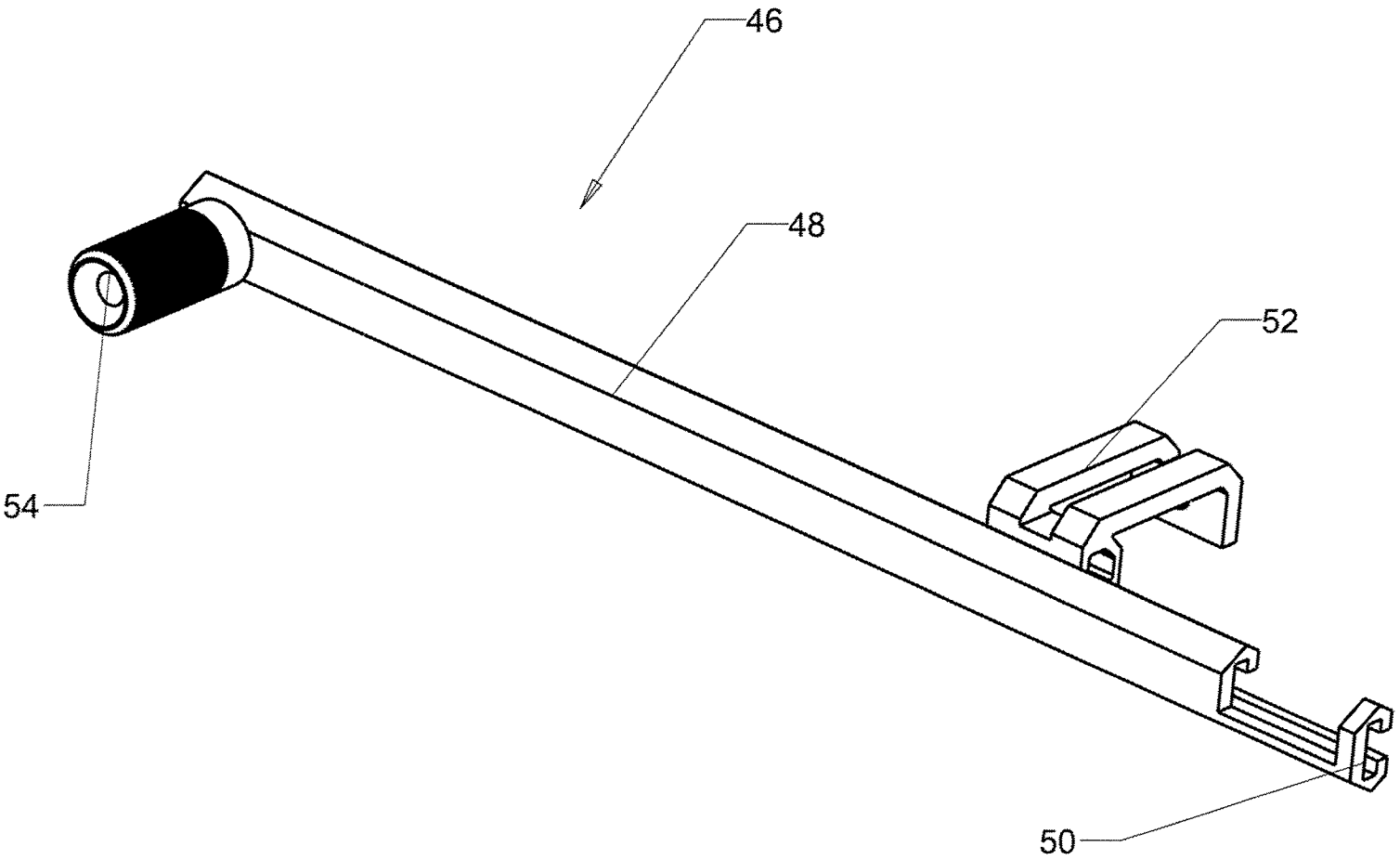
FIG. 6 is a perspective left side view of an alternative embodiment of the present invention.
Figure 7:
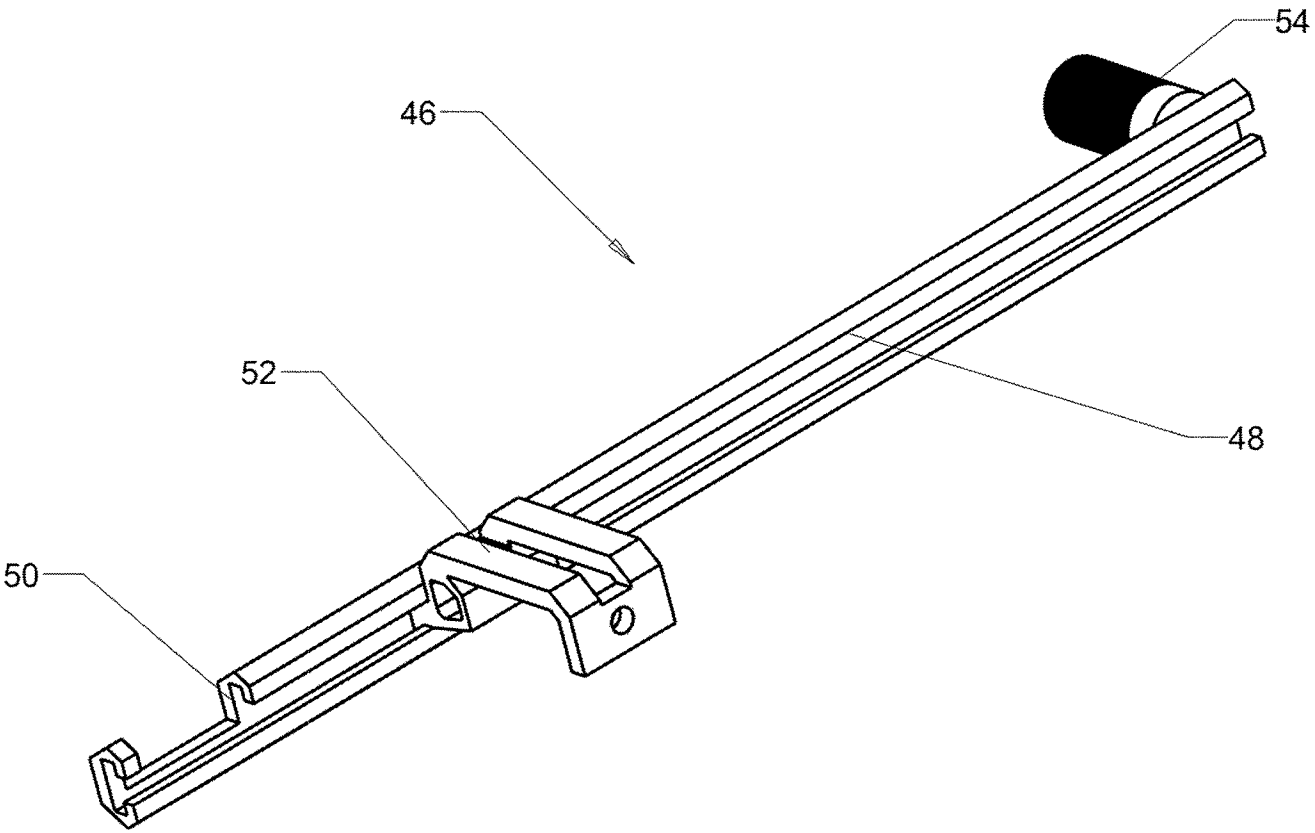
FIG. 7 is a perspective right side view of the alternative embodiment of the invention shown in FIG. 6.
Figure 8:
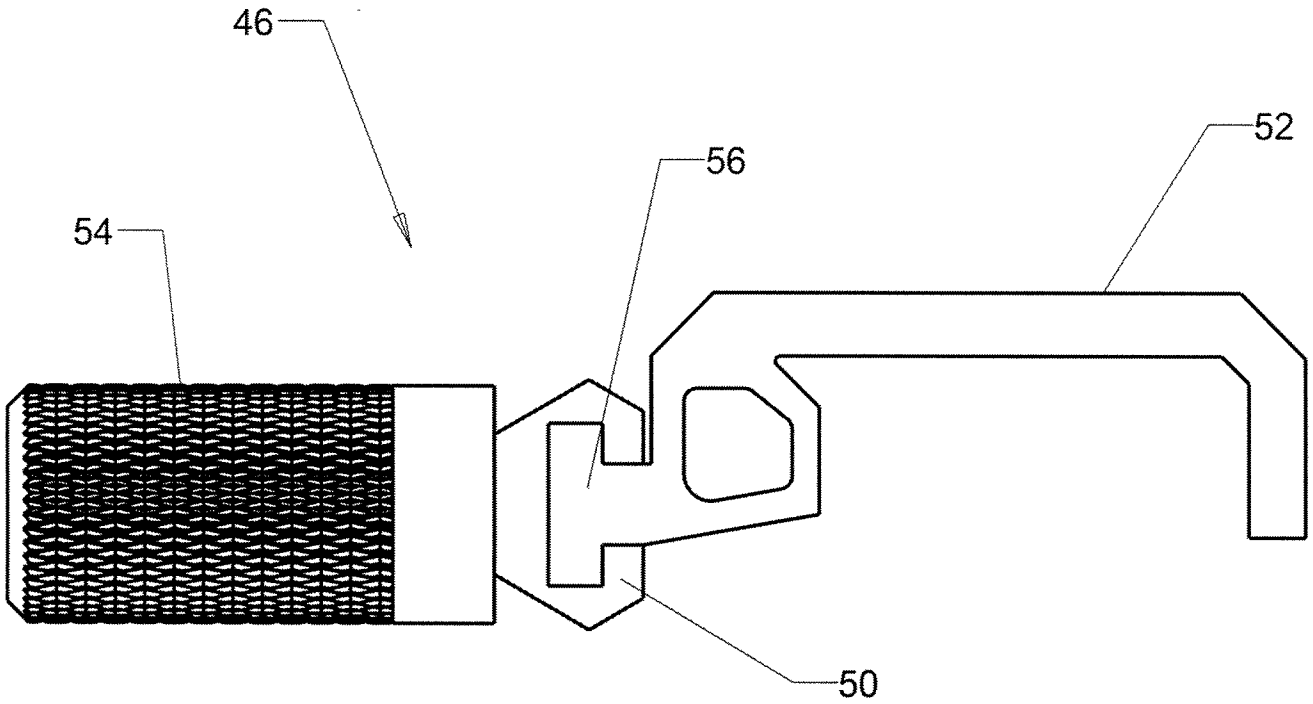
FIG. 8 is a rear view of the alternative embodiment of the invention shown in FIG. 6.

In FIGS. 6-8, an alternative embodiment of the present invention is shown. In FIG. 6 there is shown the charging handle assembly 46 of the present invention having a handle 54 attached to a channeled shaft 48 and a mounting clamp 52. The shaft 48 is able to move laterally in relation to the mounting clamp 52. The shaft 48 consists of an interior channel 50 that slides over the rail guide 56 of the mounting clamp 52. The rail guide 56 is shown as a "T" shaped form extending from the left side of the mounting clamp 52 and matches the geometric shape of the interior channel 50. The interior channel 50 and the rail guide 56 can be produced as a square, circle, triangle, or other geometric shapes.

Figure 9:
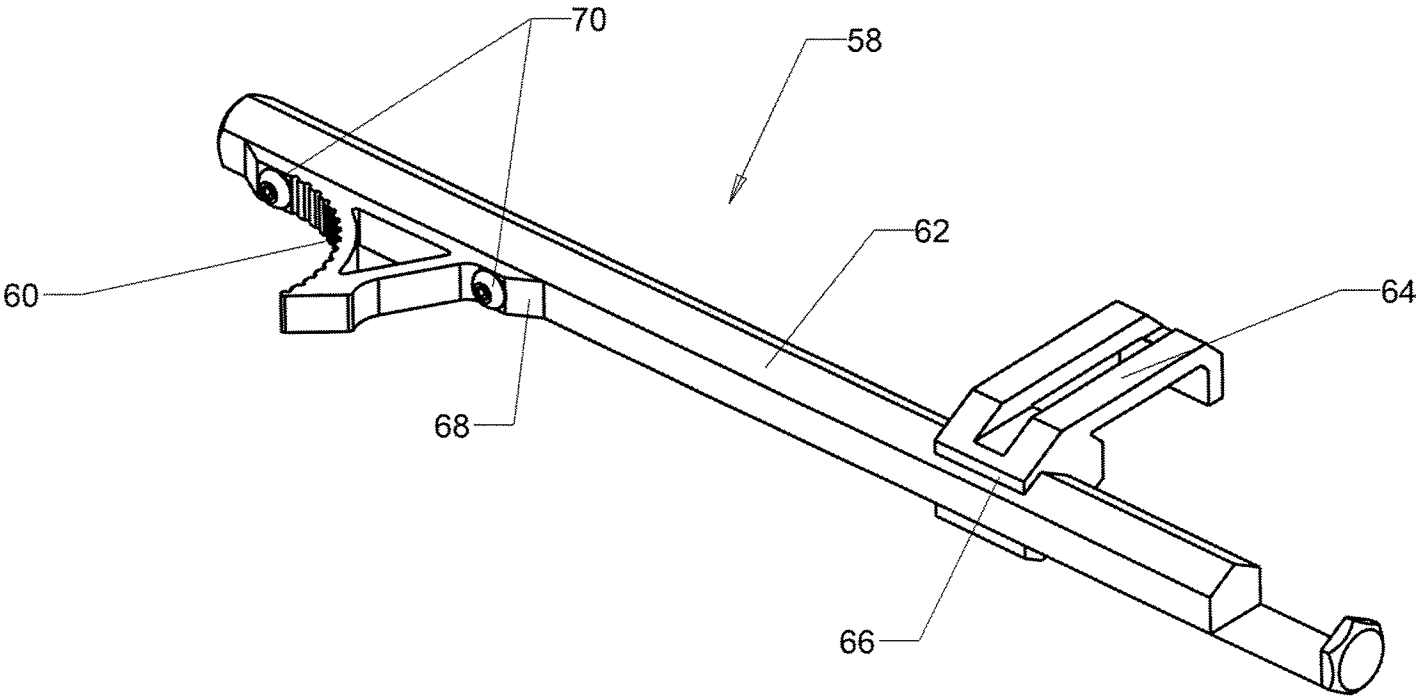
FIG. 9 is a perspective left side view of a further alternative embodiment of the present invention.

In FIG. 9, a further alternative embodiment of the present invention is shown. In FIG. 9, charging handle assembly 58 of the present invention is shown having a handle 60 attached to a shaft 62 and a mounting clamp 64. The shaft 62 is able to move laterally in relation to the mounting clamp collar 66. The shaft 62 slides within an open collar 66 of the mounting clamp 64. The base of the handle 68 is thinner than the collar 66 at its mounting point to be able to slide within the opening in the collar as defined by the edges of the collar. Although the handle in this embodiment has an even cross section, other geometric shapes can be used. The handle 60 is attached to the shaft 62 with attachment features 70. The attachment features are shown as button head cap screws but can be attached with many other attachment features such as different types of screws, pins, or press fits.

Figure 10:
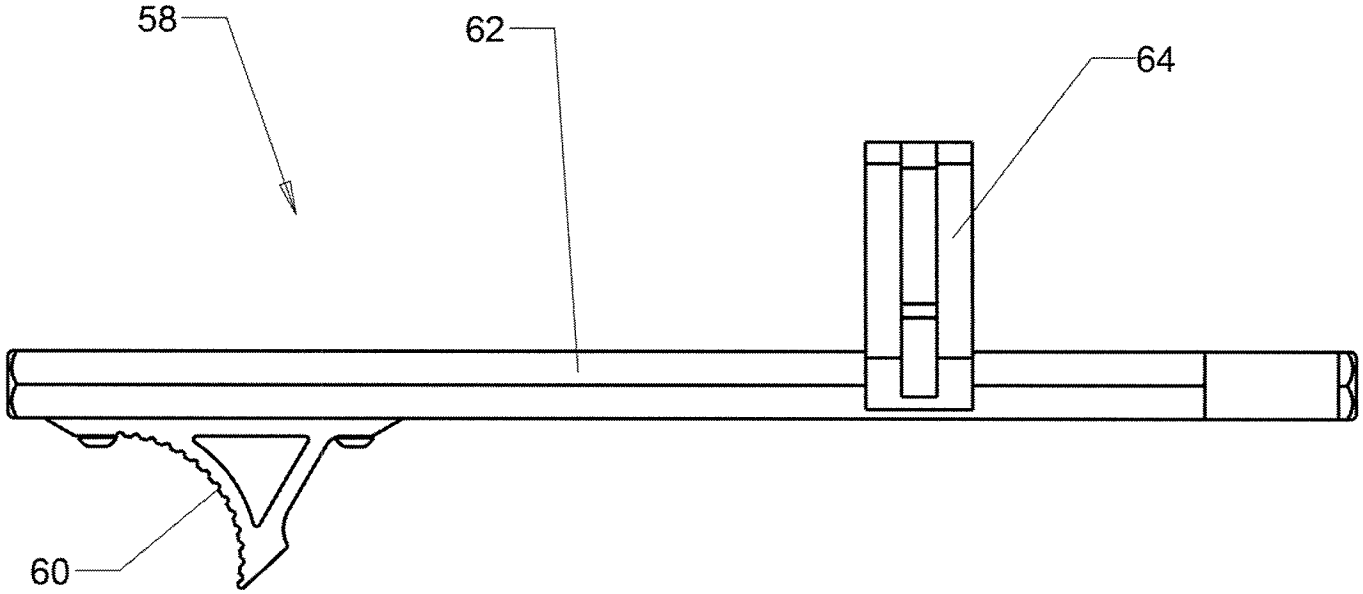
FIG. 10 is a top view of the alternative embodiment of the present invention shown in FIG. 9.

FIG. 10 shows the charging handle assembly 58 of the present invention from a top view. The handle 60 and shaft 62 can slide to the rear through the mounting clamp 64 without impingement from the clamp 64.

Figure 11:
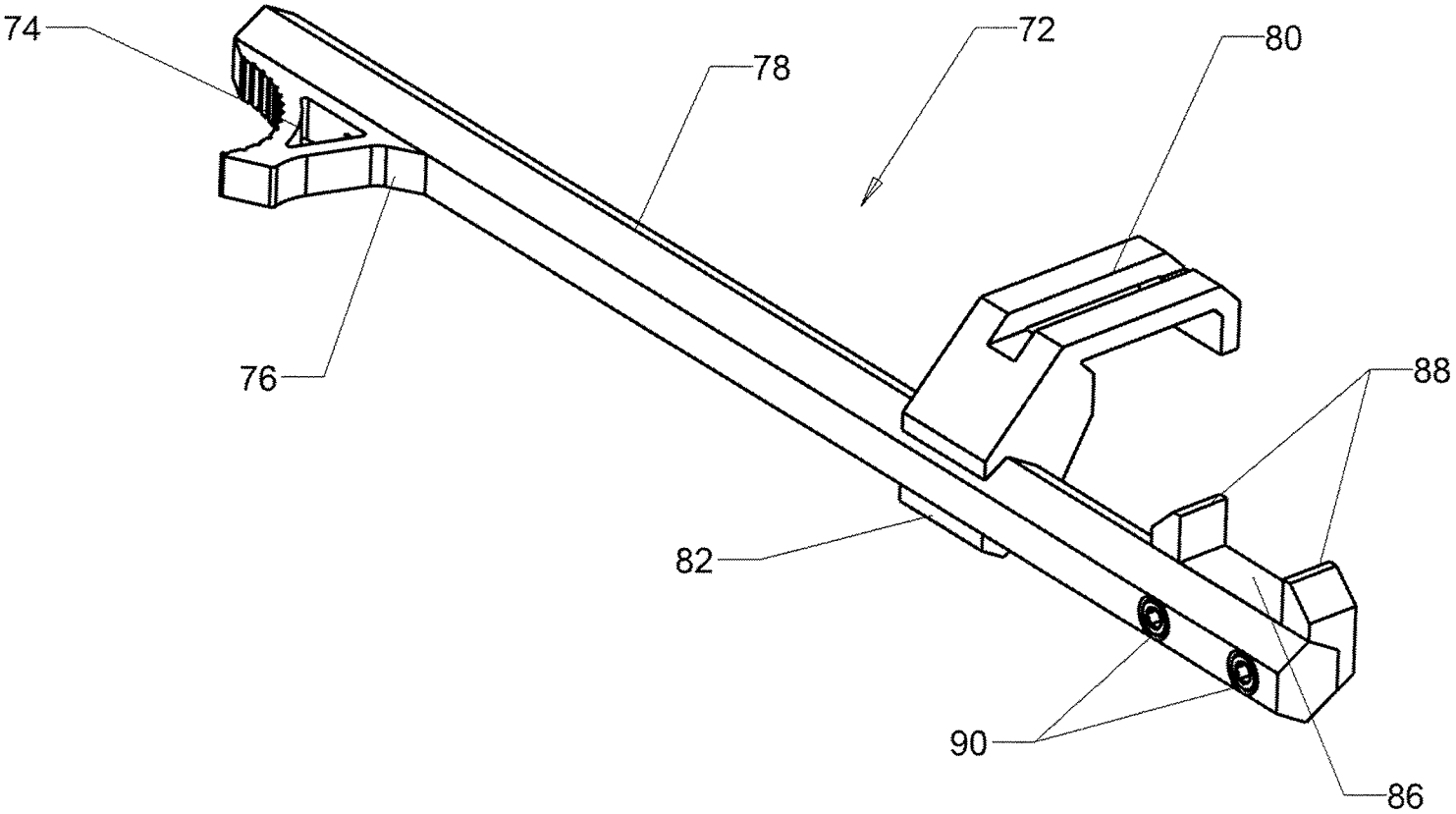
FIG. 11 is a left perspective view of a further alternative embodiment of the present invention.

In FIG. 11, another alternative embodiment of the charging handle assembly 72 is shown. In FIG. 11 there is shown the invention having a handle 74 having a handle base 76, attached to a shaft 78. The shaft 78 slidably fits within a collar 82 of a mounting clamp 80. This embodiment also consists of a bracket 86 mounted at the rear of the shaft 78 with attachment features 90. This bracket 86 consists of one or more flange 88.

Figure 12:
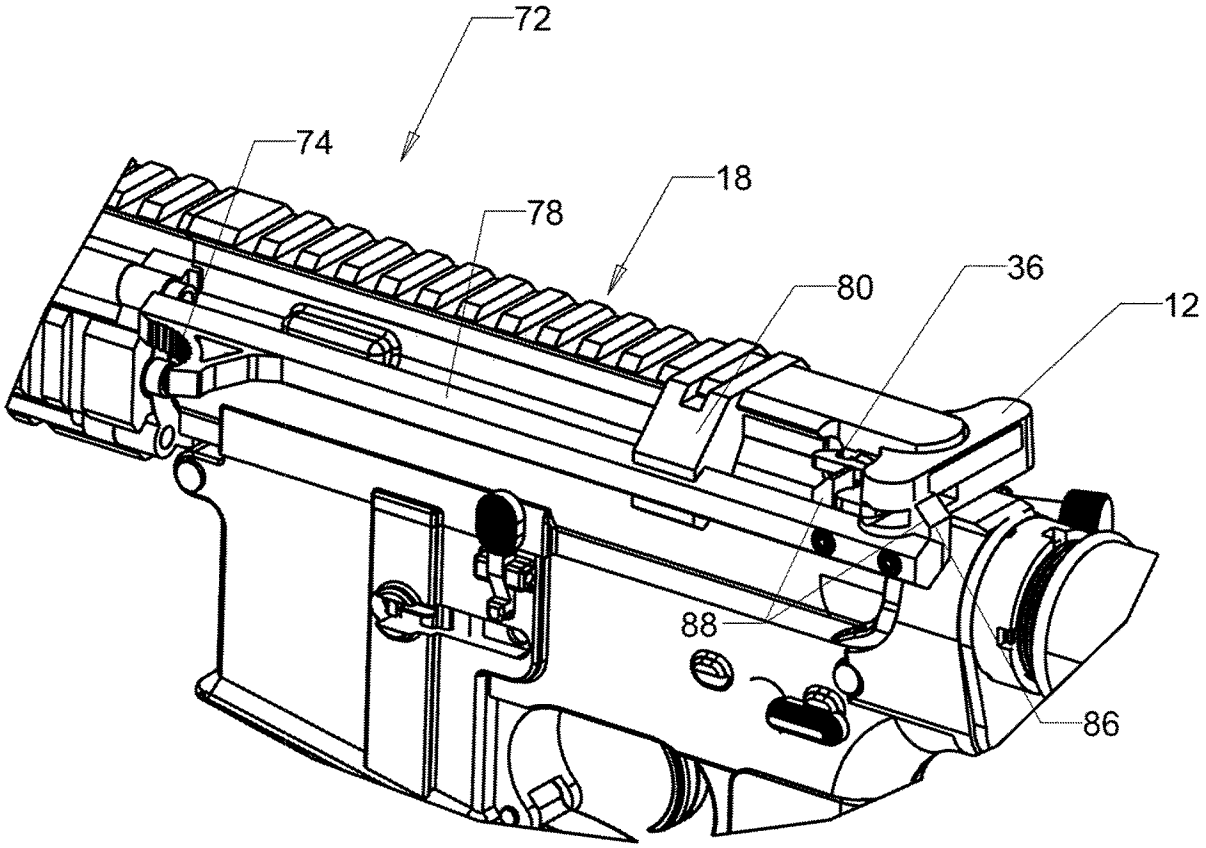
FIG. 12 is a left perspective view of the further alternative embodiment of the present invention shown in FIG. 11 and attached to a firearm.

In FIG. 12, the alternative embodiment of invention shown in FIG. 11 is depicted with the charging handle accessory 72 mounted on the top rail of the firearm 18. Attached to the shaft 78 are a handle 74 and a bracket 86. The bracket is shown as having two flanges 88 which provides sufficient pushing or pulling ability of the charging handle 12. The flanges 88 of the bracket are spaced apart from each other encompassing the width of the firearm's charging handle latch 36. The mounting clamp 80 provides the shaft 78 with clearance between the side of the firearm and the top rail 18 while the bracket 86 is in contact with the charging handle latch 36. Furthermore, the bracket 86 allows for the shaft 78 to be further offset as the bracket is solely engaging the charging handle 12.

The construction details of the invention, as shown for all embodiments in FIGS. 1-5, 6-8, 9-10, 11-12, respectively, are that the charging handle accessory 14 may be made of metal or of any other sufficiently rigid and strong material such as high-strength plastic, wood, and the like. Further, the various components of the charging handle accessory 14 can be made of different rigid materials or composites.

The shafts 28, 48, 62, and 78 of the embodiments of the invention may be made in different geometric shapes. The cross section of each shaft is currently depicted as a hexagonal shape to prevent shaft rotation, but could also be produced as a square, circle, triangle, or other geometric shapes. Furthermore, the shaft can be produced as a hollow tube having any said geometric shape.

The advantages of the present invention include, without limitation, the ability to manipulate the charging handle from the side of the firearm rather than the rear. This allows the user to more comfortably operate the charging handle. It is also non-permanent and easy to attach and detach as necessary from railed attachment points on the firearm. Its non-permanence distinguishes it as an accessory and not an internal firearm part.

In operation, the present invention affixes to the firearm on the top rail of the firearm's receiver. This mount also features a collar by which a shaft translates parallel to the length of the firearm. A handle is affixed at the front of the shaft and the charging handle of the firearm fits within a slot in the rear of the shaft.

When the present invention is affixed to the firearm, the charging handle is manipulated by the handle of the invention rather than the original handle of the charging handle of the firearm. By pulling rearward on the handle of the present invention, the shaft of the present invention depresses and opens or releases the latch of the charging handle of the firearm and subsequently pushes the charging handle of the firearm to the rear of the rifle. In one embodiment of the present invention, when the charging handle can no longer travel to the rear, the user releases the handle of the present invention and allows the charging handle of the firearm to return to its forward position via the standard biased spring mechanism associated with the charging handle within the firearm. Alternatively, the charging handle of the firearm also can be used in connection with or independent of the spring mechanism to push the shaft of the present invention back to its initial forward position.

The advantages of the present invention include, without limitation, the ability to manipulate the charging handle of the firearm from the side of the firearm rather than the rear.

The present invention allows the user to more comfortably operate the charging handle of the firearm. The side charging system can be more ergonomically appealing than a rear charging system.

The invention also allows for the firearm's bolt to be locked to the rear, an operation that normally requires relocation of both hands on the rifle, to be performed with the relocation of only one hand. This eliminates the need to remove the rifle from the user's shoulder as is necessary when relocating both hands in traditional operation.

The present invention can increase the speed of operating the charging handle of the firearm and subsequently any functions associated with the firearms that require the use of the charging handle. The present invention also has the possibility to increase the safety of operation by allowing the user to minimize unsafe movement of the barrel of the firearm during the operation of the charging handle of the firearm.

The present invention also attaches to the firearm on a location above the trigger that does not negatively affect the balance of the firearm because the majority of the firearm's weight is located in this position.

The present invention contains only one moving part which reduces the likelihood of errors or jamming. The present invention, as embodied, also has a robust and simple design being less likely to be bent into an unusable shape with heavy use.

The present invention allows the charging handle latch of the firearm to function without modification. This enables the present invention to work with many different types of aftermarket charging handles without much complication.

The location and size of the present invention's handle enables the user to adequately grasp the handle under numerous different environmental conditions.

Due to the present invention's single connection point with the firearm, the invention is simple to attach or remove. The present invention is entirely external to the firearm and no modifications of the firearm's components are required for the attachment or use of the present invention. The present invention is a non-permanent accessory that is easy to attach and detach as necessary from railed attachment points on the firearm.

The present invention has a low profile in relation to the side, front, and top views of the firearm. This low profile reduces the likelihood of the present invention interfering with any other accessories that the user may attach to the firearm. This non-obtrusive design is visually appealing and is further supported by the angular embodiment of components.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

What is claimed is:

1. A firearm accessory that assists in relocating the position of a charging handle of a firearm, the firearm having a barrel, butt stock, top rail, charging handle with a latch and a bolt catch/release and biased spring mechanism on either bilateral side of the firearm, the firearm accessory comprising:

a. a mounting clamp attached to the rear of the top rail of the firearm;

b. a collar offset extending from the mounting clamp on the side of the firearm on which the bolt catch/release is located;

c. a shaft that is slidably mounted on the collar so that the shaft can slide along the longitudinal axis of the fireman, the shaft having a forward end towards the barrel of the firearm and a rear end towards the buttstock of the firearm;

d. a handle at the forward end of the shaft for slidably moving the firearm accessory and the shaft handle between forward and rearward positions; and e. a slot at the rear end of the shaft that receives and holds the charging handle of the firearm and whereby the slot receives and holds the charging handle without fixed attachment between the slot and charging handle;

whereby, the slot is positioned in relation to the charging handle so that, in operation, a user of the firearm accessory, with a forward hand, pulls rearward on the handle of the shaft of the firearm accessory at the forward position of the shaft handle to depress and open the latch of the charging handle of the firearm and thereby push the charging handle of the firearm rearward; and whereby the user pushes the shaft handle of the firearm accessory forward from the rearward position of the shaft handle to cause the shaft to pull the charging handle of the firearm into a closed and latched position.

2. The firearm accessory of claim 1, whereby the slot has a front surface area positioned toward the front end of the shaft to contact the latch and a rear surface area positioned toward the rear end of the shaft to contact the charging handle.

3. The firearm accessory of claim 1, wherein the top rail of the firearm has transverse ridges and the mounting clamp has a transverse slot and predetermined width that permits the mounting clamp to fit over and receive a single transverse ridge of the top rail of the firearm so that the mounting clamp does not protrude above the top of the transverse ridges.

4. The firearm accessory of claim 1, wherein the collar of mounting clamp is offset a predetermined distance from a side of the firearm so that the shaft is able to slide without obstruction.

5. The firearm accessory of claim 1, wherein the shaft is slidably mounted on the collar by an opening formed in the collar that receives and holds the shaft.

6. The firearm accessory of claim 1, wherein the shaft is slidably mounted on the collar by a rail guide extension from the collar that fits within a longitudinal channel of the shaft.

7. The firearm accessory of claim 1, wherein the slot is formed in the shaft.

8. The firearm accessory of claim 1, wherein the slot is formed in an attachment to the shaft.

9. The externally mounted firearm accessory of claim 1, wherein the biased spring mechanism in the charging handle acts to push the charging handle of the firearm forward into a closed and latched position.

10. A method of using a charging handle accessory for a firearm, the firearm having a barrel, buttstock, top rail, foregrip, charging handle with a latch and a bolt catch/release and a biased spring mechanism on either bilateral side of the firearm, and the firearm accessory comprising:

a. a mounting clamp attached to the rear of the top rail of the firearm;

b. a collar offset extending from the mounting clamp on the side of the firearm on which the bolt catch/release is located;

c. a shaft that is slidably mounted on the collar so that the shaft can slide along the longitudinal axis of the fireman, the shaft having a forward end towards the barrel of the firearm and a rear end towards the butt stock of the firearm;

d. a handle at the forward end of the shaft for slidably moving the firearm accessory between forward and rearward positions; and e. a slot at the rear end of the shaft that receives and holds the charging handle of the firearm accessory;

whereby the user of the firearm accessory engages the firearm accessory at the forward position of the accessory and pulls the handle of the shaft in a rearward motion towards the butt stock of the firearm so that the rear slot on the shaft acts to depress and open the latch of the charging handle and push the charging handle of the rifle rearward, and, once the charging handle reaches an end point of rearward movement, the user releases the handle of the shaft and the biased spring mechanism in the charging handle pushes the charging handle and shaft forward and the charging handle returns to a close and latched position.

11. The method of claim 10, wherein the shaft follows the linear motion of the charging handle and the user controls the motion of the shaft and charging handle solely through interaction of the user's forward hand with the handle of the shaft.

12. The method of claim 10, wherein the user uses a single hand to operate the handle of the firearm accessory and the opposite hand of the user holds the foregrip of the firearm.

13. The method of claim 10, wherein the user's operation of pulling the shaft handle and thereby pushing the charging handle rearward also activates the bolt catch/release to lock the bolt in a rearward position.

14. The method of claim 10, wherein the user keeps the butt stock of the firearm mounted to the user's shoulder while operating the accessory in forward and rearward positions and, by interaction with the slot in the shaft, moving the charging handle forward and rearward.

15. The method of claim 10, wherein the charging handle latch is depressed and opened by interaction of the slot in the shaft with the charging handle and through the user's operation of the shaft handle to pull the shaft to the rearward position of the shaft handle.

16. A method of using a charging handle accessory for a firearm, the firearm having a barrel, buttstock, top rail, foregrip, charging handle with a latch and a bolt catch/release and a biased spring mechanism on either bilateral side of the firearm, and the firearm accessory comprising:

a. a mounting clamp attached to the rear of the top rail of the firearm;

b. a collar offset extending from the mounting clamp on the side of the firearm on which the bolt catch/release is located;

c. a shaft that is slidably mounted on the collar so that the shaft can slide along the longitudinal axis of the fireman, the shaft having a forward end towards the barrel of the firearm and a rear end towards the buttstock of the firearm;

d. a handle at the forward end of the shaft for slidably moving the firearm accessory and shaft handle between forward and rearward positions; and e. a slot at the rear end of the shaft that receives and holds the charging handle of the firearm accessory;

whereby the user of the firearm accessory engages the firearm accessory at the forward position of the accessory and pulls the handle of the shaft in a rearward motion towards the butt stock of the firearm so that the rear slot on the shaft depresses and open the charging handle latch and pushes the charging handle of the rifle rearward to depress and open the latch of the charging handle of the firearm and push the charging handle of the firearm rearward, and, once the charging handle reaches an end point of rearward movement, the user pushes the handle of the firearm accessory forward to pull the charging handle of the firearm into a closed and latched position.

17. The method of claim 16, wherein the biased spring mechanism in the charging handle also acts to push the charging handle and shaft forward and, thereby, to push the charging handle to a closed and latched position.

* * * * *